US008478180B2

(12) United States Patent
Arimoto et al.

(10) Patent No.: US 8,478,180 B2
(45) Date of Patent: Jul. 2, 2013

(54) IMAGE HEATING APPARATUS

(75) Inventors: Kota Arimoto, Kashiwa (JP); Ryo Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 247 days.

(21) Appl. No.: 12/956,522

(22) Filed: Nov. 30, 2010

(65) Prior Publication Data

US 2011/0129267 A1 Jun. 2, 2011

(30) Foreign Application Priority Data

Dec. 2, 2009 (JP) ..... 2009-274338

(51) Int. Cl.
*G03G 15/20* (2006.01)
*H05B 11/00* (2006.01)

(52) U.S. Cl.
USPC ..... 399/329; 399/69; 399/320; 399/333; 219/210; 219/216

(58) Field of Classification Search
USPC ..... 399/320, 329, 69, 333; 219/216, 219/201
See application file for complete search history.

(56) References Cited

U.S. PATENT DOCUMENTS

| | | | | |
|---|---|---|---|---|
| 5,083,168 | A * | 1/1992 | Kusaka et al. | 399/329 |
| 6,864,461 | B2 * | 3/2005 | Okabayashi et al. | 219/216 |
| 7,136,601 | B2 * | 11/2006 | Akizuki et al. | 399/69 |
| 7,209,696 | B2 * | 4/2007 | Umezawa et al. | 399/329 |
| 7,283,780 | B2 | 10/2007 | Uchida et al. | |
| 7,536,145 | B2 | 5/2009 | Tomine et al. | |
| 7,561,818 | B2 | 7/2009 | Arimoto et al. | |
| 7,684,724 | B2 | 3/2010 | Arimoto et al. | |
| 7,764,895 | B2 | 7/2010 | Tomine et al. | |
| 7,907,870 | B2 * | 3/2011 | Haseba et al. | 399/122 |
| 8,346,148 | B2 * | 1/2013 | Yonekawa et al. | 399/329 |
| 2006/0233575 | A1 | 10/2006 | Uchida et al. | |
| 2007/0059021 | A1 | 3/2007 | Hanashi et al. | |
| 2009/0169231 | A1 * | 7/2009 | Asakura et al. | 399/69 |
| 2010/0180785 | A1 | 7/2010 | Arimoto et al. | |
| 2011/0150545 | A1 * | 6/2011 | Nihonyanagi et al. | 399/329 |

FOREIGN PATENT DOCUMENTS

| | | | |
|---|---|---|---|
| EP | 585857 | A1 * | 3/1994 |
| JP | 07-006414 | | 1/1995 |
| JP | 2006-293225 | | 10/2006 |
| JP | 2007-272223 | | 10/2007 |
| JP | 2011133839 | A * | 7/2011 |

* cited by examiner

*Primary Examiner* — David Gray
*Assistant Examiner* — Francis Gray
(74) *Attorney, Agent, or Firm* — Fitzpatrick, Cella, Harper & Scinto

(57) ABSTRACT

An image heating apparatus includes a belt including a heat generating layer for generating heat by energization and including a power receiving portion which has electroconductivity and is electrically connected to the heat generating layer; a stationary back-up member, provided inside the belt, for sliding on an inner peripheral surface of the belt; a pressing member for pressing the belt against the back-up member to form a nip in which a recording material is to be nip-conveyed between the belt and itself; and an electroconductive portion, provided on the back-up member, for supplying electric power to the power receiving portion by being electrically connected to the power receiving portion.

11 Claims, 7 Drawing Sheets

IMAGE HEATING APPARATUS

FIELD OF THE INVENTION AND RELATED ART

The present invention relates to an image heating apparatus of a belt heating type suitable as an image fixing device (apparatus) to be mounted in an image forming apparatus, such as a copying machine, a facsimile machine, a printer or a multi-function machine of these machines, for forming an image on a recording material by an image forming process such as an electrophotographic process or an electrostatic recording process.

Examples of the image heating apparatus may include a fixing device for fixing or temporarily fixing an unfixed image on the recording material as a fixed image, and a gloss increasing device for increasing gloss of an image by heating the image fixed on the recording material.

In recent years, in the image forming apparatus, from the viewpoint of energy saving, a device (apparatus) having small thermal capacity has been proposed and put into practical use as the fixing device which is the image heating apparatus. As a specific means for decreasing the thermal capacity of the fixing device, an endless belt of a belt heating type (belt fixing type) is used as an image heating member.

In the fixing device of the belt heating type described in Japanese Laid-Open Patent Application (JP-A) Hei 07-6414 and JP-A 2006-293225, a ceramic heater as a heat generating member is disposed in a nip formed between the belt and a pressing member. In the nip, a recording material on which an unfixed toner image is carried is nip-conveyed, and the unfixed toner image is fixed on a surface of the recording material as the fixed image by heat of the heater through the belt. This fixing device includes the heater and the belt which have small thermal capacity, thus having the advantages that a waiting time from power-on of the image forming apparatus until an image formable state of the image forming apparatus is short (quick start property) and that power consumption during stand-by is considerably small (power saving).

With respect to the image forming apparatus (fixing device) of the belt heating type, as a constitution capable of further improving energy efficiency compared with the constitution described above, it would be considered that a heat generating layer for generating heat by energization is provided in the belt and the energy is supplied to the heat generating layer to cause the belt itself to generate heat. That is, in the case where the image is heated in the nip by the heat of the heater through the belt, there is a need to apply a lubricant such as grease onto the heater or form a sliding layer of polyimide or fluorine-containing resin on the heater surface in order to prevent wearing (abrasion) of the inner surface of the belt by friction between the heater and the belt. The lubricant or the sliding layer constitutes thermal resistance between the heater and the belt. This is because when the belt itself is configured to generate heat, the thermal resistance component can be eliminated.

As described in JP-A 2007-272223, in a constitution in which the heat generating layer for generating heat by energization is provided in the belt, there is a need to devise an energization constitution to the heat generating layer. That is, in the case where the image heating member has high rigidity and is a roller member including a core metal which is a rotation shaft to be fixed, a locus of an outer peripheral surface of the image heating member during a rotation operation is stabilized. For that reason, by forming an electrical path through the outer peripheral surface of the core metal, it is possible to easily establish the energization constitution for stably supplying energy (power) from a power source portion to the heat generating member on the roller member side. This is because, however, in the case where the image heating member has low rigidity and is a flexible belt free from the rotation shaft, a behavior during the rotation operation is unstable and therefore it is difficult to employ the constitution for stably supplying the (electric) power from the outer peripheral surface as in the case of the roller member described above. That is, in the constitution in which the power is supplied from the outer peripheral surface of the belt, when an urging force of an energization member against the belt is increased, stable electrical connection between the energization member and the heat generating layer can be established but it is difficult to apply the constitution to the low-rigidity belt since breakage such as buckling is liable to occur. Further, in the case where the energization to the heat generating layer is unstable, reduction in rise time cannot be realized and when the energization becomes unstable during passing of the recording material, the heat generating layer cannot be generate heat corresponding to necessary thermal capacity. For that reason, a so-called cold offset such that the toner image on the recording material cannot be fixed occurs.

SUMMARY OF THE INVENTION

A principal object of the present invention is to provide an image heating apparatus, including a belt having a heat generating layer which generates heat, capable of stably supplying power to the heat generating layer.

According to an aspect of the present invention, there is provided an image heating apparatus comprising:

a belt including a heat generating layer for generating heat by energization and including a power receiving portion which has electroconductivity and is electrically connected to the heat generating layer;

a stationary back-up member, provided inside the belt, for sliding on an inner peripheral surface of the belt;

a pressing member for pressing the belt against the back-up member to form a nip in which a recording material is to be nip-conveyed between the belt and itself; and an electroconductive portion, provided on the back-up member, for supplying electric power to the power receiving portion by being electrically connected to the power receiving portion.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

(1) Image Forming Apparatus

Figure 1:
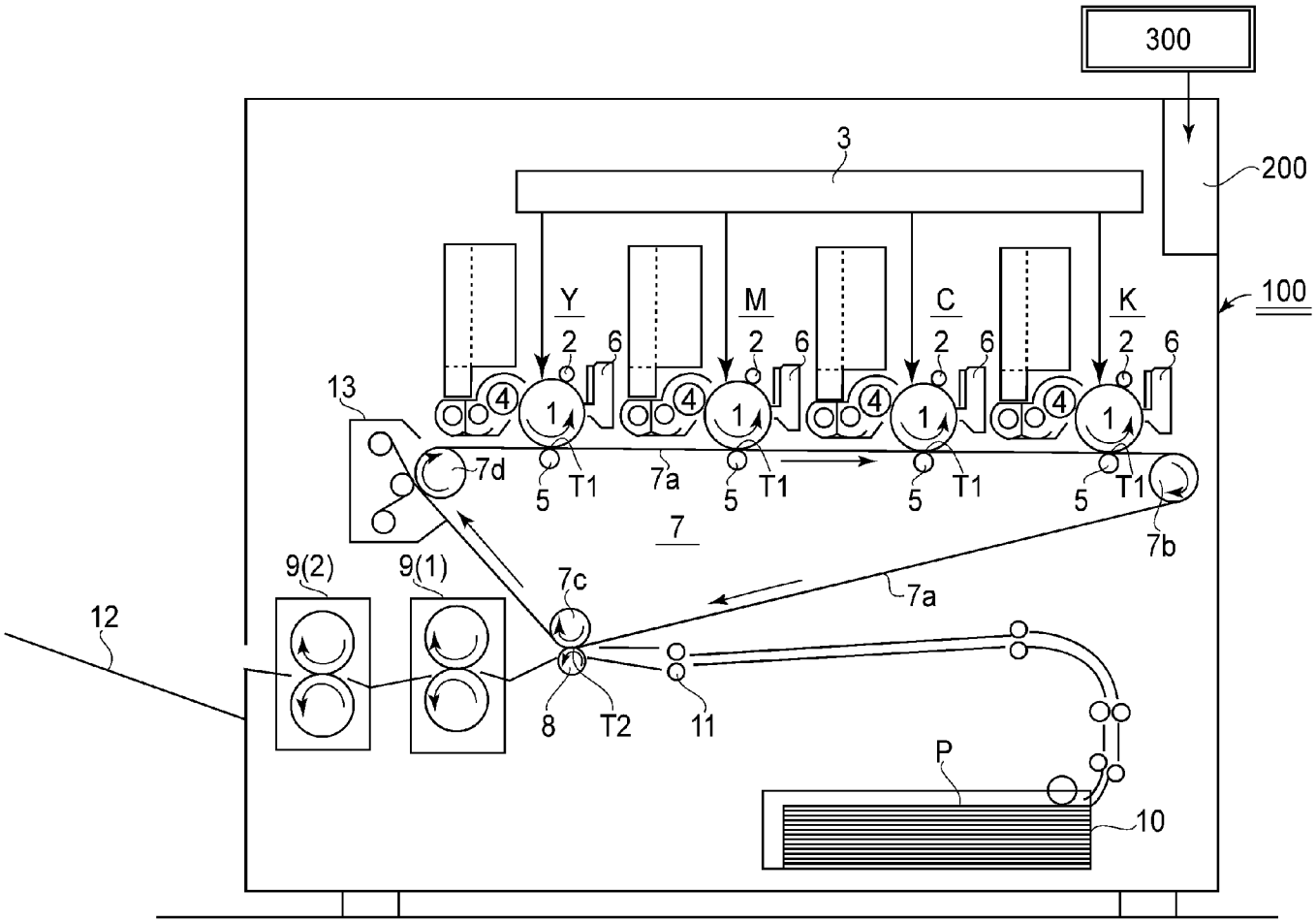
FIG. 1 is a schematic structural view of an image forming apparatus in Embodiment 1.

FIG. 1 is a schematic structural view of an example of an image forming apparatus 100 in which an image heating apparatus according to the present invention is mounted as a fixing device 9. This image forming apparatus 100 is a four-color based full-color laser beam printer of an electrophotographic type, a tandem type and an intermediary transfer type. That is, on the basis of electrical image information inputted from a host device 300 to a control circuit portion (CPU) 200, the image forming apparatus 100 is capable of forming a four-color based full-color image on a recording material P. The host device 300 is an image reading device (image reader), a personal computer, or the like, which is communicatably connected to the image forming apparatus 100.

A constitution of the image forming apparatus 100 itself will be briefly described. On a basis of a print start signal, an electrophotographic photosensitive drum 1 of each of first to fourth electrophotographic image forming portions Y, M, C and K is rotated in the counterclockwise direction indicated by an arrow at a predetermined speed. An endless belt 7*a* of an intermediary transfer belt unit 7 is circulated and moved in the clockwise direction indicated by an arrow at a speed corresponding to the rotational speed of the drum 1. A laser scanner 3 is also driven. Each of the image forming portions includes a charging roller 2, the laser scanner 3, a developing device 4, a primary transfer roller 5 and a cleaning device 6, which are process means acting on the drum 1. The belt 7*a* is extended and stretched around three rollers consisting of a driving roller 7*b*, a secondary transfer opposite roller 7*c* and a tension roller 7*d*. The primary transfer roller 5 press-contacts the belt 7*a* against a lower surface of the drum 1 at each image forming portion. The contact portion between the drum 1 and the belt 7*a* constitutes a primary transfer portion T1. A secondary transfer roller 8 press-contacts the belt 7*a* against the secondary transfer opposite roller 7*c*. The contact portion between the belt 7*a* and the secondary transfer roller 8 constitutes a secondary transfer portion T2. On the drum 1 at the first image forming portion Y, a toner image of yellow (Y) corresponding to a yellow component of the full-color image is formed and then is primary-transferred onto the belt 7*a* at the primary-transfer portion T1 of the first image forming portion Y. On the drum 1 at the second image forming portion M, a toner image of magenta (M) corresponding to a magenta component of the full-color image is formed and then is primary-transferred superposedly onto the toner image of Y, which has already been transferred onto the belt 7*a*, at the primary transfer portion T1 of the second image forming portion M. On the drum 1 at the third image forming portion C, a toner image of cyan (C) corresponding to a cyan component of the full-color image is formed and then is primary-transferred superposedly onto the toner images of Y and M, which have already been transferred onto the belt 7*a* at the primary-transfer portion T1 of the third image forming portion Y. On the drum 1 at the fourth image forming portion K, a toner image of black (K) corresponding to a black component of the full-color image is formed and then is primary-transferred superposedly onto the toner images of Y, M and C, which have already been transferred onto the belt 7*a*, at the primary transfer portion T1 of the fourth image forming portion K. Thus, unfixed toner images of Y, M, C and K for the four-color based full-color image are synthetically formed on the moving belt 7*a*. These unfixed toner images are conveyed to reach the secondary transfer portion T2 by further movement of the belt 7*a*.

On the other hand, sheets of the recording material P stacked and accommodated in a sheet feeding cassette 10 are fed one by one with predetermined control timing, and the fed recording material P is conveyed to a registration roller pair 11. The recording material P is then conveyed to the secondary transfer portion T2 with predetermined control timing by the registration roller pair 11. In a process in which the recording material P is nip-conveyed at the secondary transfer portion T2, the superposed four color toner images are collectively secondary-transferred from the belt 7*a* onto the surface of the recording material P. The recording material P coming out of the secondary transfer portion T2 is separated from the belt 7*a* and is successively passed through a first fixing device 9(*a*) and a second fixing device 9(2), so that the toner images are fixed on the recording material P. The fixing of the toner images on the recording material P is performed by applying heat and pressure to the recording material P. The recording material P which has been subjected to the fixing is discharged on a sheet discharging tray 12 as a color-image formed product. Secondary transfer residual toner remaining on the surface of the belt 7*a* after the secondary transfer of the toner images onto the recording material P is removed by a belt cleaning device 13.

(2) Fixing Device

Figure 2:
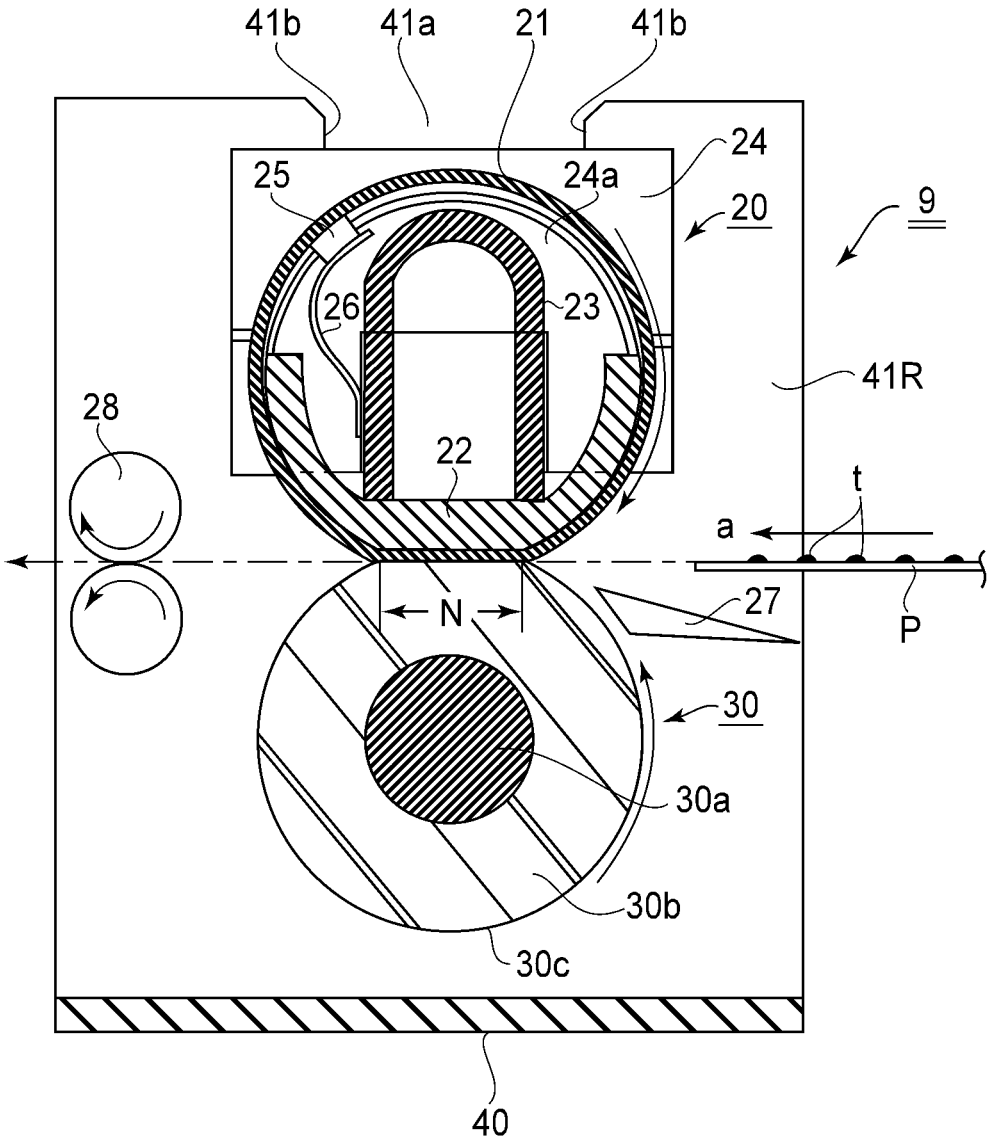
FIG. 2 is a cross-sectional left side view of a fixing device.
Figure 3:
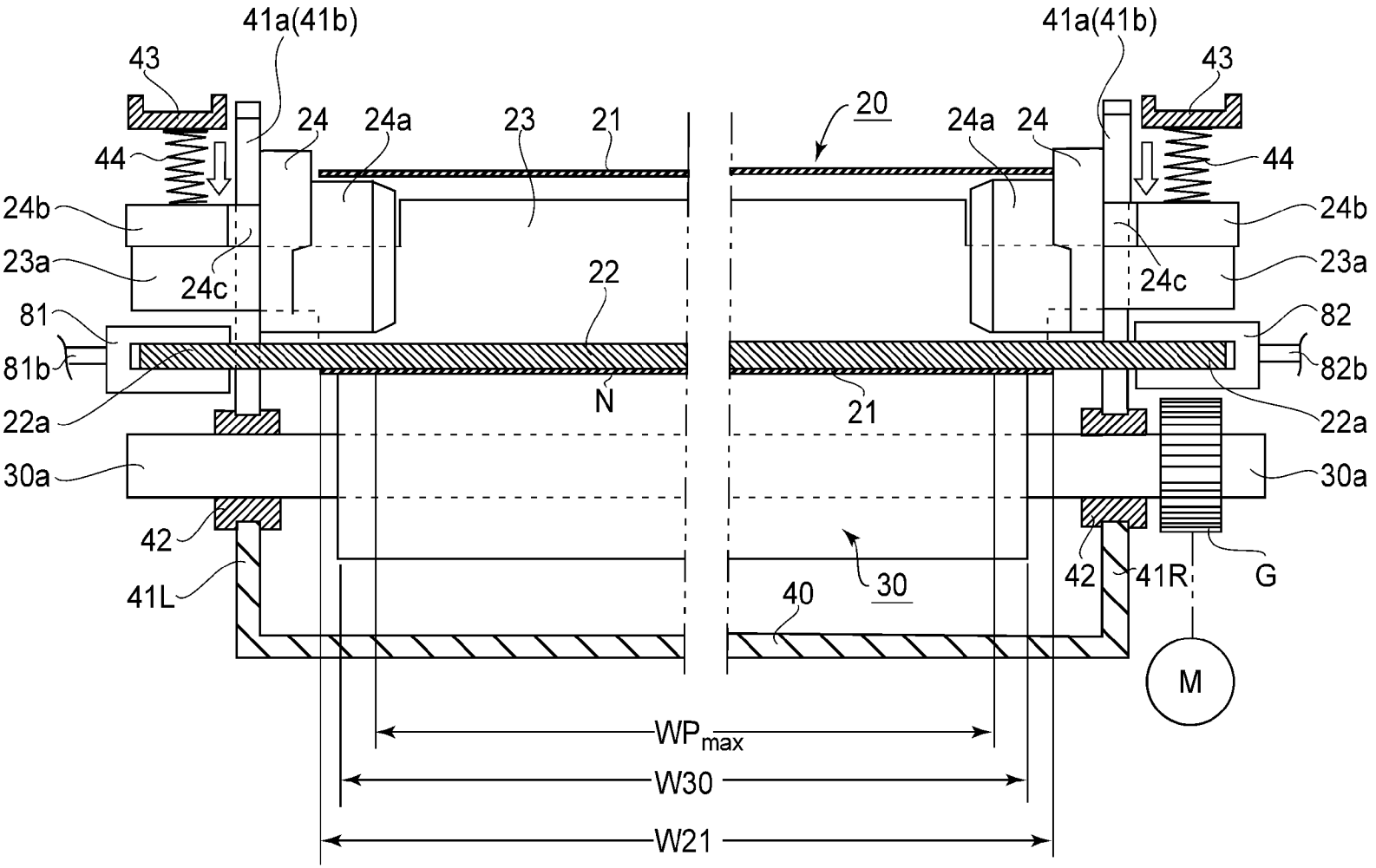
FIG. 3 is a partly cut-away front view of the fixing device which is partly omitted.

FIG. 2 is a cross-sectional left side view of the fixing device 9, and FIG. 3 is a partly cut-away front view of the fixing device 9 which is partly omitted. In this embodiment, the first fixing device 9(1) and the second fixing device 9(2) are a belt heating type image heating apparatus and have the same structure, and use an endless belt having a heat generating layer which generates heat by energization as an image heating member. That is, the fixing device 9 in this embodiment includes a flexible and rotatable endless belt 21. The fixing device also includes a stationary back-up member 22 which is disposed inside the belt 21 and is configured to slide on the inner peripheral surface of the belt 21. Further, the fixing device 9 includes a rotatable pressing member 30 which press-contacts the belt 21 against the back-up member 22 to form a nip N between itself and the belt 21. Further, the fixing device 22 heats the recording material P, on which images t are carried, in the nip N while conveying the recording material P. In the following description, with respect to the fixing device 9, a "front surface" is a surface of the fixing device 9 as seen from a recording material introducing port side. A "rear surface" in a surface opposite from the front surface. "Left and right" (sides) are those as seen from the front surface side. Further, with respect to the fixing device 9 and other constituent elements thereof, a "longitudinal direction" is a direction perpendicular to a recording material movement (conveyance) direction in a plane of a recording material conveying path. A "width" of the recording material or a "sheet passing width" is a dimension of the recording material with respect to the direction perpendicular to the recording material conveyance direction.

The fixing device 9 includes a belt assembly 20 as a heating member (fixing member) and a pressing roller 30 as a (rotatable) pressing member. The belt assembly 20 and the pressing roller 30 are vertically arranged in substantially parallel to each other between left and right side plates 41L and 41R of a fixing device frame 40.

The pressing roller 30 has a multi-layer structure including a core metal 30*a* of stainless steel, a silicone rubber layer 30*b* as an elastic layer formed on the core metal 30*a* in a roller shape coaxially with the core metal 30*a*, and a tube layer 30*c* of PFA resin as a parting layer (surface layer) formed on the silicone rubber layer 30*b*. The pressing roller 30 is rotatably supported between the left and right side plates 41L and 41R through bearing members 42 at left and right end portions of the core metal 30*a*. At a right-side end portion of the core metal 30*a*, a drive gear G is fixed. A rotational force is transmitted from a driving source (motor) M to the gear G through a power transmitting mechanism (not shown), so that the pressing roller 30 is rotationally driven in the counterclockwise direction indicated by an arrow in FIG. 2 at a predetermined speed.

The belt assembly 20 is prepared by assembling the flexible endless belt 21 as the image heating member, the back-up member 22, the supporting stay (urging stay) 23, left and right flange members 24, a thermistor 25 as a temperature detecting member, and the like.

1) Belt 21

Figure 4:
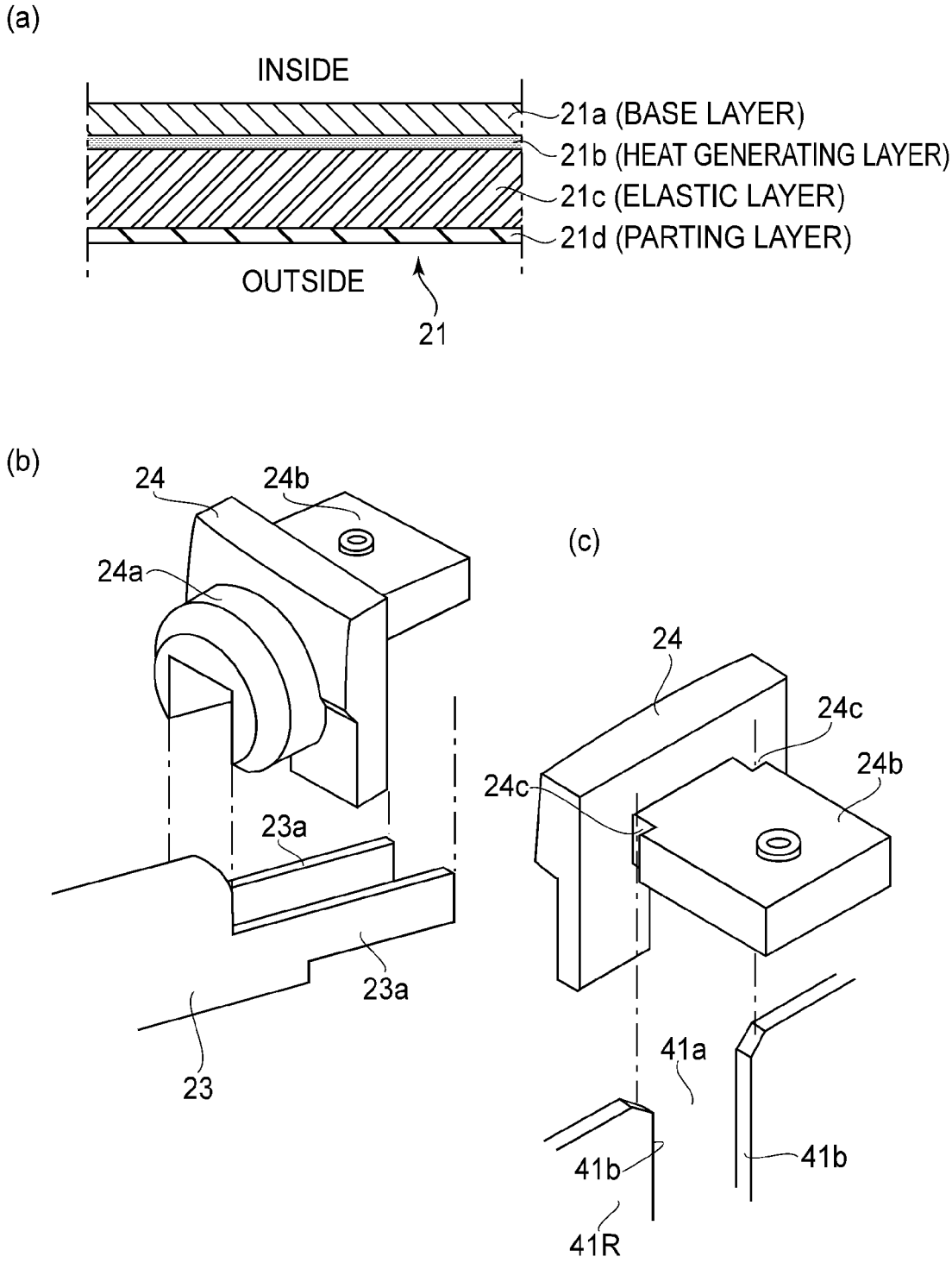
FIG. 4(*a*) is a schematic view showing a layer structure of a belt, FIG. 4(*b*) is an exploded perspective view of a right-side flange member and a right-side outwardly extended portion of a supporting stay, and FIG. 4(*c*) is a schematic view for illustrating an engaging structure between the flange and a side plate of a device frame.

FIG. 4(*a*) is a schematic view showing a layer structure of the belt 21. The belt 21 is a cylindrical belt (endless belt which at least includes the heat generating layer 21*b* for generating heat by energization and which has flexibility as a whole. The belt 21 in this embodiment basically has a four-layer composite structure consisting of a base layer 21*a*, the heat generating layer 21*b*, an elastic layer 21*c* and a parting layer 21*d* in the order from its inner peripheral surface side to its outer peripheral surface side. That is, the belt 21 includes the heat generating layer 21*b* formed on the outer peripheral surface of the cylindrical base layer 21*a*, the elastic layer 21*c* formed on the outer peripheral surface of the heat generating layer 21*b*, and the parting layer 21*d* formed at an outermost peripheral surface. Incidentally, FIG. 4(*a*) is merely the schematic view and thus dimensional ratios among the respective layers do not coincide with those specifically described below as example. Further, on the left and right sides of the belt 21, electroconductive power supplying portion and power receiving portion electrically connected to the heat generating layer 21*b* in order to supply power to the heat generating layer 21*b* are provided but will be described later.

The base layer 21*a* is a flexible member which is insulative and has a cylindrical shape. The base layer 21*a* can be formed of a heat-resistant material in a thickness of 100 μm or less, preferably 50 μm less and 20 μm or more, in order to decrease thermal capacity to improve a quick start property. For example, as the base layer 21*a*, it is possible to use a resin belt of, e.g., polyimide, polyimideamide, PEEK, PTFE, PFA, FEP, or the like or to use a metal belt of SUS, nickel, or the like for the purpose of enhancing rigidity of the belt. In this embodiment, a cylindrical polyimide belt of 30 μm in thickness and 25 mm in diameter was used. Incidentally, in the case where an electroconductive material is used for forming the base layer 21*a*, there is a need to provide an insulating layer of polyimide or the like between the base layer 21*a* and the heat generating layer 21*b*.

The heat generating layer 21*b* generates heat by energization and may preferably be formed of a material prepared by mixing an electroconductive material in a resin material. According to this mixed material, it is possible to easily prepare the heat generating layer 21*b* capable of having various resistance values only by changing a mixing ratio between the resin material and the electroconductive material. In this embodiment, the heat generating layer 21*b* is a heat generating resistor prepared by applying polyimide resin containing carbon black as electroconductive particles on the base layer 21*a* in a uniform thickness of about 10 μm. A total resistance value of the heat generating layer 21*b* is 10.0Ω. Therefore, electric power (amount of heat generation) consumed during application of a commercial voltage of 100 V from an AC voltage source (power source) is 1000 W.

As the elastic layer 21*c* in this embodiment, a 300 μm-thick silicone rubber layer having a rubber hardness of 10 degrees (JIS-A hardness) and a thermal conductivity of 1.3 W/m.K was used.

The parting layer 21*d* is the surface layer of the belt 21 and may preferably be formed of fluorine-containing resin. The parting layer 21*d* is formed of the fluorine-containing resin having high parting property, so that it is possible to obtain a parting performance between the belt 21 and the toner on the recording material P and to prevent toner offset. In this embodiment, as the parting layer 21*d*, a 20 μm-thick PFA tube was used. Further, as the parting layer 21*d*, a PFA coating layer may also be used. Depending on necessary thickness, mechanical strength and electrical strength, the PFA tube and the PFA coating layer can appropriately be selected and used. Further, the parting layer 21*d* is bonded to the elastic layer 21*c* with an adhesive of silicone resin.

2) Back-Up Member 22

The back-up member 22 is an elongated member which is inserted into the belt 21 and has a substantially semicircular tub-like shape in cross section and further has rigidity, heat resistance and heat insulating property. On an outer surface of the back-up member 22, the inner peripheral surface of the belt 21 slides. The back-up member 22 may desirably be formed of a material which less conducts the heat to the supporting stay 23 from the viewpoint of energy saving and may be formed of, e.g., heat-resistant glass or heat-resistant resin such as polycarbonate or liquid crystal polymer. Further, as described later, a constitution in which the power is supplied to the heat generating layer 21*b* of the belt 21 through the electroconductive portion provided on the back-up member 22 is employed in this embodiment and therefore it is essential to use the insulating material as the material for the back-up member 22. In this embodiment, as the material, "SUMIKA SUPER E5204L", mfd. by Sumitomo Chemical Company was used. The back-up member 22 functions as a rotation guide of the belt 21 which is loosely and externally engaged on the back-up member 22. Further, the back-up member 22 also functions as a means for pressing (urging) the belt 21 toward the pressing roller 30.

3) Supporting Stay 23

The supporting stay 23 is an elongated rigid member which is provided inside the back-up member 22 and has a downward (reversed) U shape in cross section. The supporting stay 23 may desirably be formed of a material which is less bent even when a high pressure is applied thereto. In this embodiment, SUS 304 was used. The supporting stay 23 supports the back-up member 22.

4) Flange Member 24

The left and right flange members 24 are a regulating (preventing) member for preventing lateral movement (deviation) of the belt 21 toward a left end or a right end along a longitudinal direction of the back-up member during the rotation of the belt 21 and for regulating a shape of the belt 21 with respect to a circumferential direction of the belt 21 during the rotation of the belt 21. The left and right flange members 24 are bilaterally symmetrical and are engaged and fitted on left and right outwardly extended arm portions 23*a* of the supporting stay 23. FIG. 4(*b*) is an exploded perspective view of a right-side flange member 24 and a right-side outwardly extended arm portion 23*a* of the supporting stay 23. In the engaged and fitted state of the left and right flange members 24 described above, a disk-like inner belt guide portion 24*a* disposed on an inner surface side of each of the left and right flange members 24 enters the inside of the belt 21 through an opening on each of left and right end portion sides of the belt 21. As a result, the shape of the belt 21 with respect to the circumferential direction during the rotation of the belt 21 is regulated. The left and right end surfaces of the belt 21 oppose the inner surfaces of the left and right flange members 24, respectively, with a slight gap. As a result, the leftward or rightward lateral movement of the back-up member 22 during the rotation of the belt 21 is prevented.

5) Thermistor 25

The thermistor 25 is disposed above the supporting stay 23 so as to be elastically contacted to the inner surface of the belt 21 and has the function of detecting a temperature of the inner surface of the belt 21. Specifically, the thermistor 25 is mounted on an end portion of a stainless steel arm 26 fixed and supported on the supporting stay 23 and is placed in a state in which the thermistor is elastically contacted to the inner surface of the belt 21 by externally engaging the belt 21 on the back-up member 22 and the supporting stay 23. Further, the arm 26 is elastically swung, so that the thermistor 25 is kept in the state in which the thermistor 25 is always contacted to the inner surface of the belt 21 even in a state in which motion of the inner surface of the belt 21 becomes unstable.

Then, the belt assembly 20 which is the assembled member of the above-described members 21 to 25 and the like is arranged on the pressing roller 30 in substantially parallel to the pressing roller 30 with a downward back-up member 22 side and is disposed between the left and right side plates 41L and 41R of the device frame 40. The left and right flange members 24 are provided with vertical groove portions 24*c* (FIG. 4(*c*)) which are engaged with vertical edge portions 41*b* of a vertical guide slit 41*a* provided in each of the left and right side plates 41L and 41R of the device frame 40. Then, an urging spring 44 is compressedly provided between an urging portion 24*b* and an urging arm 43 of each of the left and right flange members 24. As a result, the belt 21 is urged against the upper surface of the pressing roller 30 through the left and right flange members 24, the supporting stay 23 and the back-up member 22 with a pressing roller urging force, so that a fixing nip N with a pressing roller width is formed with respect to a recording material conveyance direction a. In this embodiment, the urging force is 156.8 N on one end side and thus is 313.6 N (32 kgf) in total. In the nip, the belt 21 is bent by following a lower flat surface of the back-up member 22 while being sandwiched between the lower flat surface of the back-up member 22 and the pressing roller 30, so that the belt 21 is placed in a state in which its inner surface intimately contacted to the lower flat surface of the back-up member 22.

Then, the rotational force is transmitted from the driving source M to the drive gear G of the pressing roller 30, so that the pressing roller 30 is rotationally driven in the counter-clockwise direction at the pressing roller speed as shown in FIG. 2. By the rotational drive of the pressing roller 30, the rotational force acts on the belt 21 by a frictional force between the pressing roller 30 and the belt 21 in the nip N. As a result, the belt 21 is rotated, by the rotation of the pressing roller 30, around the back-up member 22 in the clockwise direction (FIG. 2) while intimately contacting and sliding on the lower surface of the back-up member at its inner surface (pressing roller driving type). Onto the inner surface of the belt 21, grease is applied, so that wearing (abrasion) of the inner surface of the belt 21 occurring due to the friction between the back-up member 22 and the inner surface of the belt 21.

Further, by the energization constitution described later, the power is supplied to the heat generating layer 21*b* of the rotating belt 21. The belt 21 is head by the heat generation of the heat generating layer 21*b* to increase in temperature, and the temperature of the belt 21 is detected by the thermistor 25. The thermistor 25 is connected to the control circuit portion 200 as a control means through an A/D converter 201 (FIG. 5(*b*)). This control circuit portion 200 samples an output from the thermistor 205 at a pressing roller internal, and resultant temperature information is reflected in energization control of the heat generating layer 21*b*. That is, the control circuit portion 200 determines the contents of the control of the energization to the heat generating layer 21*b* on the basis of the output of the thermistor 25 and controls the power to be supplied from a (main) power source portion 202 to the heat generating layer 21*b*. In the control by the fixing device 9 in this embodiment, in view of a temperature for fixing the toner image on the recording material, a detection temperature of the thermistor 25 is controlled to be kept at a constant value of 160° C.

In a state in which the belt 21 is increased in temperature up to a preset temperature and temperature-controlled at the temperature by rotating the belt 21 by the rotation of the pressing roller 30 and then by supplying the power to the heat generating layer 21*b*, the recording material P carrying thereon the unfixed toner images t is introduced along a guide 27 into the nip N. In the nip N, the toner image carrying surface of the recording material P intimately contacts the outer surface of the belt 21, so that the recording material P moves together with the belt 21. In a nip-conveying process of the recording material P in the nip N, the heat generated by the heat generating layer 21*b* is applied to the recording material P, so that the unfixed toner images (images) t are melted and fixed on the recording material P. The recording material P having passed through the nip N is separated by curvature and then is discharged by fixing discharge rollers 28.

In this embodiment, the recording material P is passed through the nip N on a recording material width center line basis, i.e., by a so-called center line-based conveyance. In FIG. 3, "WPmax" is a maximum sheet passing width of the recording material P. "W30" is a pressing roller width (length (dimension) of the elastic roller portion 30*b*). "W21" is a belt width (distance between left and right ends of the belt 21). These widths are set to satisfy: WPmax<W30≦W21. A length (dimension) of the back-up member 22 is more than the belt width W21, a dimension of the nip N perpendicular to the recording material conveyance direction a (longitudinal nip dimension) is more than the pressing roller width W30.

(3) Energization Constitution

Figure 5:
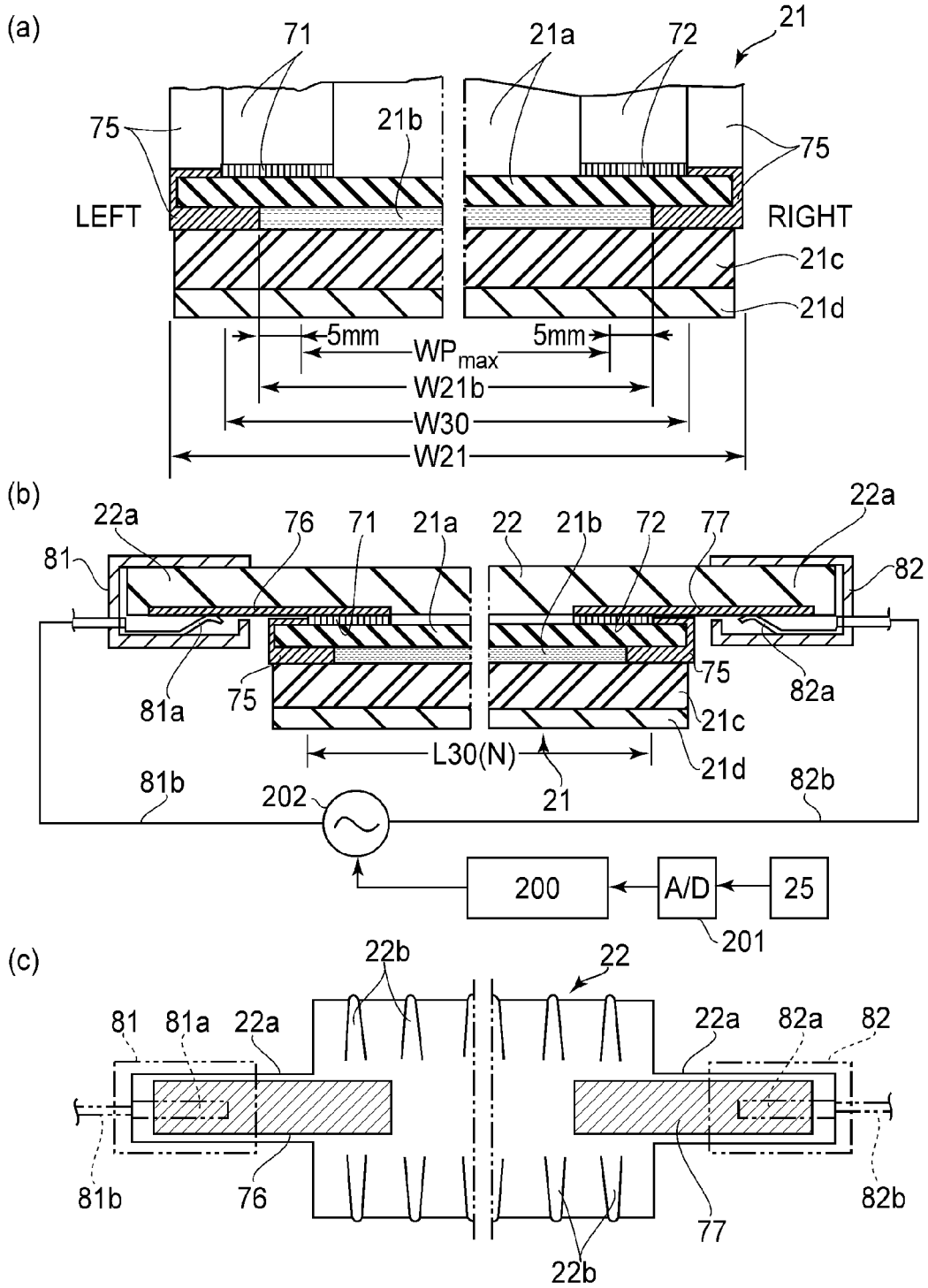
FIGS. 5(*a*) to 5(*c*) are schematic views each showing an energization constitution with respect to an electroconductive layer.

The energization constitution with respect to the heat generating layer 21*b* of the belt 21 will be described. FIG. 5(*a*) is a schematic sectional view showing a layer structure of the belt 21 at left and right end portions. On the left and right sides of the inner surface of the belt 21, a power supplying portion (electrode portion) 71 and a power receiving portion (electrode portion) 72 which have electroconductivity and a ring-like shape with respect to the circumferential direction are formed, respectively. Further, the power supplying portion 71 and the power receiving portion 72 are electrically connected to the left and right ends of the heat generating layer 21*b*, respectively, through (electro-)conductive paths 75. That is, the conductive paths 75 for electrically connecting the power supplying portion 71 and the power receiving portion 72 to the heat generating layer 21*b* are formed via the end portions of the belt 21. The conductive paths 75 may only be required to be electrically connecting the power supplying portion 71 and the power receiving portion 72 to the heat generating layer 21*b* and thus may be free from a ring-like electroconductive pattern. Each of the power supplying portions 71, the power receiving portion 72 and the conductive paths 75 is formed of the material which contains silver-palladium to possess an electroconductive property.

On the other hand, the back-up member 22 includes the outwardly extended arm portions 22*a* which are provided by extending the lower surface portions thereof, constituting the nip N, leftward and rightward. Further, as shown in FIGS. 5(*b*) and 5(*c*), the left and right outwardly extended arm portions 22*a* are provided with a first electroconductive portion) 76 and a second electroconductive portion (electrode portion) 77, respectively, at their lower surfaces. The first electroconductive portion 76 and the second electroconductive portion 77 oppose the power supplying portion 71 and the power receiving portion 72 of the belt 21, respectively, and are extended to at least a portion where the back-up member 22 urges the belt 21 against the pressing roller 30, i.e., the range of the fixing nip N. The first electroconductive portion 76 and the second electroconductive portion 77 are also formed of the material which contains silver-palladium to possess the electroconductive property. The fixing device 9 in this embodiment has the constitution in which the first electroconductive portion 76 and the second electroconductive portion 77 are provided only in the range of the nip N but is not particularly limited to this constitution. When the first and second electroconductive portions 76 and 77 are provided at least in the range of the nip N, it is possible to realize good contact between the backup member 22 and the belt 21. Therefore, a constitution in which the first and second electroconductive portions 76 and 77 are extended to the outside of the range of the nip N may also be employed. In FIG. 5(*c*), arcuate guide ribs 22*b* following the belt rotational direction are provided on the outer surface of the back-up member 22 with spacings along the longitudinal direction of the back-up member 22. On the left-side outwardly extended arm portion 22*a* of the back-up member 22, a first connector 81 is engaged and fitted. As a result, a power supplying member (electrode) 81*a* of the first connector 81 is elastically contacted to the first electroconductive portion 76 to be electrically connected to the first electroconductive portion 76. Further, on the right-side outwardly extended arm portion 22*a* of the back-up member 22, a second connector 82 is engaged and fitted. As a result, a power supplying member (electrode) 82*a* of the second connector 82 is elastically contacted to the second electroconductive portion 77 to be electrically connected to the second electroconductive portion 77. The power supplying members 81*a* and 82*a* are a leaf spring-like member of stainless steel.

Thus, the back-up member 22 includes the first electroconductive portion 76 and the second electroconductive portion 77 in the area in which the back-up member 22 urges the belt 21 and in the area in which these portions 76 and 77 oppose the power supplying portion 71 and the power receiving portion 72 of the belt 21, respectively, with respect to the longitudinal direction. Further, the first electroconductive portion 76 and the second electroconductive portion 77 are extended outside the belt ends at their outside end portions and contact the power supplying members 81*a* and 82*a*, respectively, to be electrically connected to the power source portion 202 in areas outside the belt 21.

That is, at the inner surface of the belt 21, the power supplying portion 71 and the power receiving portion 72 are provided. Further, the back-up member 22 is provided with the first electroconductive portion 76 and the second electroconductive portion 77 which contact the power supplying portion 71 and the power receiving portion 72, respectively. Further, in the nip N, the power supplying portion 71 and the first electroconductive portion 76 contact each other and the power receiving portion 72 and the second electroconductive portion 77 contact each other, and the first and second electroconductive portions 76 and 77 are electrically connected to the power source portion 202. Therefore, an energization path for the heat generating layer 21*b* is constituted by the power source portion 202, a lead 81*b*, the power supplying member 81, the first electroconductive portion 76, the power supplying portion 71, the conductive path 75, the heat generating layer 21*b*, the conductive path 75, the power receiving portion 72, the second electroconductive portion 77, the power supplying member 82, a lead 82*b*, and the power source portion 202. The power source portion 202 is controlled by the control circuit portion 200. By turning on the power source portion 202, the power is supplied to the heat generating layer 21*b* through the energization path described above, so that the belt 21 is heated to be increased in temperature by the heat generation of the heat generating layer 21*b*. The temperature of the belt 21 is detected by the thermistor 25, and detection temperature information of the thermistor 25 is inputted into the contact circuit portion 200 through the A/D converter 201. The control circuit portion 200 samples, as described above, the output from the thermistor 25 at the pressing roller interval and reflects the resultant temperature information in the control of the energization to the heat generating layer 21*b*.

Also during the rotation of the belt 21, the back-up member 22 is in a rest state, so that the electrical connection between the power supplying member 81 and the first electroconductive portion 76 and between the power supplying member 82 and the second electroconductive portion 77 is satisfactorily maintained. Further, the back-up member 22 presses and urges the belt 21 including the power supplying portion 71 and the power receiving portion 72, so that the electrical connection between the first electroconductive portion 76 and the power supplying portion 71 and between the second electroconductive portion 77 and the power receiving portion 72 is also satisfactorily maintained. By the constitution in this embodiment, the electrical connection between the power source portion 202 and the heat generating layer 21*b* can be stably maintained also during the drive of the fixing device 9.

That is, a locus of the belt 21 during the rotational drive is stable in the nip N in which the belt 21 is press-contacted to the pressing roller 30. For that reason, the power can be stably supplied to the heat generating layer 21*b* by electrically connecting the power supplying portion 71 and the power receiving portion 72 of the belt 21 to the power source portion 202 in the nip N. The power supplying portion 71 and the power receiving portion 72 of the belt 21 are electrically connected to the power source portion 202 through the first electroconductive portion 76 and the second electroconductive portion 77, respectively, provided on the back-up member 22 which presses and urges the belt 21 toward the pressing roller 30. As a result, stable power supply from the power source portion 202 to the heat generating layer 21*b* can be realized. Through the conductive paths 75, the power supplying portion 71 and the power receiving portion 72 which are provided as an innermost layer of the belt 21 and contact the first electroconductive portion 76 and the second electroconductive portion 77, respectively, are electrically connected to the heat generating layer 21*b* provided on the outer peripheral surface of the base layer 21*a* of the belt 21. As a result, from the power source portion 202 to the heat generating layer 21*b*, the power can be supplied stably.

Further, in the fixing device 9 in this embodiment, with respect to the direction perpendicular to the recording material conveyance direction a in the nip N, the maximum sheet passing width WPmax of the recording material P is within (inside) a heat generation area width W21*b* of the heat generating layer 21*b*. The recording material P passes through the nip N with in the heat generation area width W21*b* of the heat generating layer 21*b*, so that a whole area of the recording material P can be heated. Further, the heat generation area width W21*b* of the heat generating layer 21*b* is 307 mm and the maximum sheet passing width WPmax of the recording material P is 297 mm, so that the heat generating layer 21*b* is longer than the recording material P by 5 mm on each of the left and right sides thereof. With respect to the temperature of the belt, a change (variation) in temperature occurs in the neighborhood of the end portions of the heat generating layer 21*b* due to the thermal transmission toward the end portions and therefore there is a need to make the heat generation area width W21*b* of the heat generating layer 21*b* larger than the maximum sheet passing width WPmax of the recording material P. Further, in the case where the heat generation area width W21*b* is excessively larger than the maximum sheet passing width WPmax, excessive temperature rise occurs in an area in which the recording material P does not pass, to that the belt 21 can be broken. In this embodiment, the heat generation area width W21*b* is made larger than the maximum sheet passing width WPmax by 5 mm on each of the left and right end portion sides, so that prevention of the change in temperature and prevention of the excessive temperature rise at recording material end positions are compatibly realized. Incidentally, each of FIGS. 5(*a*), 5(*b*) and 5(*c*) is the schematic view in which mutual ratios among respective constituent elements or portions with respect to the length, the width and the thickness are not always coincide with those described above.

As described above, according to this embodiment, in the fixing device 9 using the belt 21 including the heat generating layer 21*b* for generating heat by energization, it is possible to realize stable electric power supply to the heat generating layer 21*b*.

Embodiment 2

Figure 6:
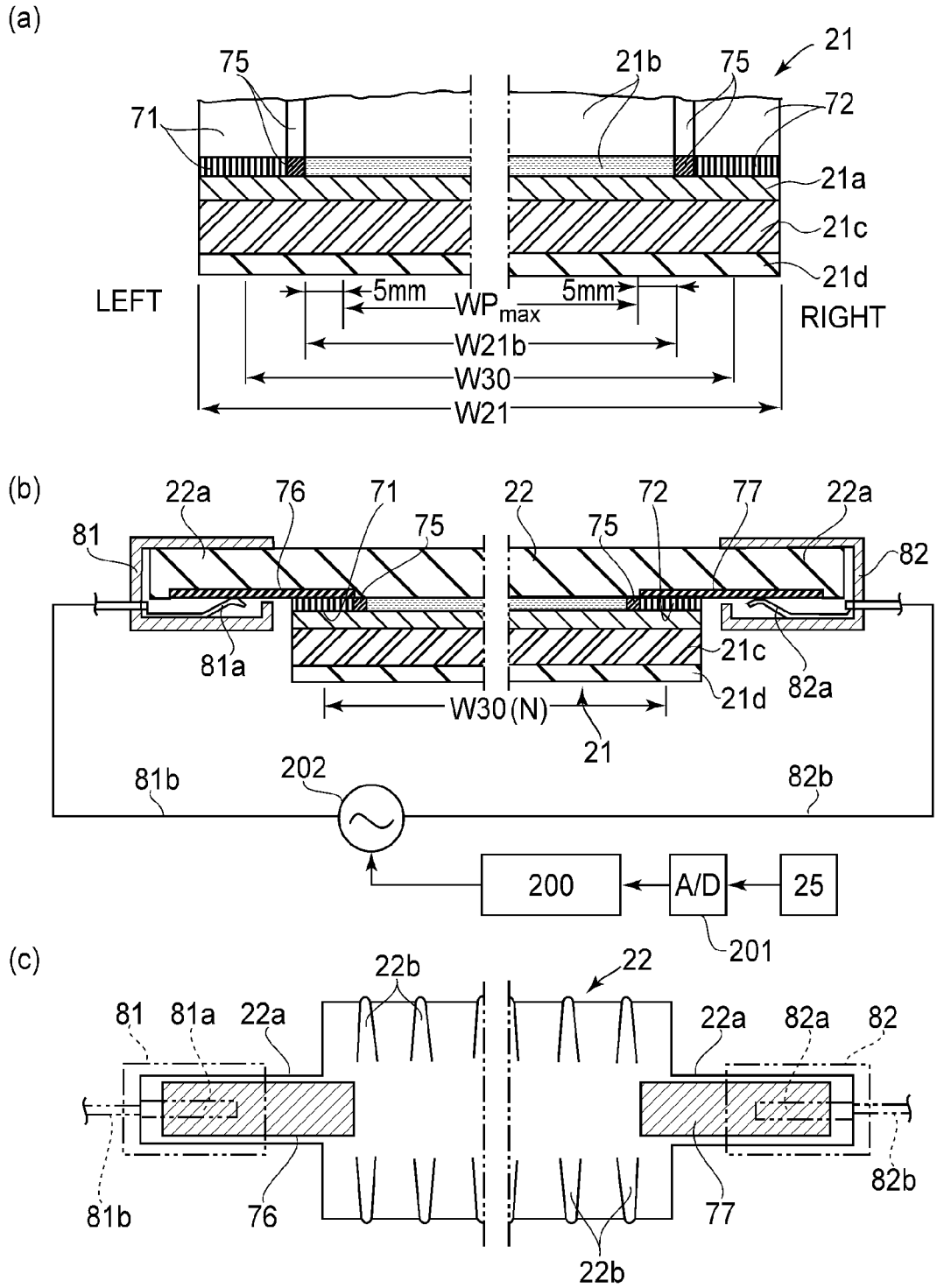
FIGS. 6(*a*) to 6(*c*) are schematic views each showing an energization constitution with respect to an electroconductive layer in a fixing device in Embodiment 2.

FIGS. 6(*a*), 6(*b*) and 6(*c*) are schematic views for illustrating a constitution in this embodiment. In this embodiment, the belt 21 has a four-layer composite structure consisting of the heat generating layer 21*b*, the base layer 21*a*, the elastic layer 21*c* and the parting layer 21*d* in the order from its inner peripheral surface side to its outer peripheral surface side. That is, the belt 21 includes the heat generating layer 21*b* formed on the inner peripheral surface of the cylindrical base layer 21*a*, the elastic layer 21*c* formed on the outer peripheral surface of the base layer 21*a*, and the parting layer 21*d* formed at an outermost peripheral surface.

On the left and right sides of the belt 21, the power supplying portion 71 and the power receiving portion 72 which have electroconductivity and a ring-like shape with respect to the circumferential direction are formed, respectively, on the inner surface of the base layer 21*a* of the belt 21. Further, the power supplying portion 71 and the power receiving portion 72 are electrically connected to the left and right ends of the heat generating layer 21*b*, respectively, through the conductive paths 75. That is, the conductive paths 75 for electrically connecting the power supplying portion 71 and the power receiving portion 72 to the heat generating layer 21*b* are formed at the innermost surface of the belt 21. The conductive paths 75 may only be required to be electrically connecting the power supplying portion 71 and the power receiving portion 72 to the heat generating layer 21*b* and thus may be free from a ring-like electroconductive pattern. Other constitutions are similar to those in Embodiment 1, and therefore in this embodiment, constituent members or portions common to Embodiment 1 are represented by the same reference numerals or symbols and will be omitted from redundant description.

Also in this embodiment, the back-up member 22 includes, as shown in FIG. 6(*b*), the first electroconductive portion 76 and the second electroconductive portion 77 in the area in which the back-up member 22 urges the belt 21 and in the area in which these portions 76 and 77 oppose the power supplying portion 71 and the power receiving portion 72 of the belt 21, respectively, with respect to the longitudinal direction. Further, the first electroconductive portion 76 and the second electroconductive portion 77 are extended outside the belt ends at their outside end portions and contact the power supplying members 81*a* and 82*a*, respectively, to be electrically connected to the power source portion 202 in areas outside the belt 21.

That is, an energization path for the heat generating layer 21*b* is constituted by the power source portion 202, a lead 81*b*, the power supplying member 81, the first electroconductive portion 76, the power supplying portion 71, the conductive path 75, the heat generating layer 21*b*, the conductive path 75, the power receiving portion 72, the second electroconductive portion 77, the power supplying member 82, a lead 82*b*, and the power source portion 202.

Also during the rotation of the belt 21, the back-up member 22 is in a rest state, so that the electrical connection between the power supplying member 81 and the first electroconductive portion 76 and between the power supplying member 82 and the second electroconductive portion 77 is satisfactorily maintained. Further, the back-up member 22 presses and urges the belt 21 including the power supplying portion 71 and the power receiving portion 72, so that the electrical connection between the first electroconductive portion 76 and the power supplying portion 71 and between the second electroconductive portion 77 and the power receiving portion 72 is also satisfactorily maintained. That is, by the constitution in this embodiment, the electrical connection between the power source portion 202 and the heat generating layer 21*b* can be stably maintained also during the drive of the fixing device 9.

That is, a locus of the belt 21 during the rotational drive is stable in the nip N in which the belt 21 is press-contacted to the pressing roller 30. For that reason, the power can be stably supplied to the heat generating layer 21*b* by electrically connecting the power supplying portion 71 and the power receiving portion 72 of the belt 21 to the power source portion 202 in the nip N. The power supplying portion 71 and the power receiving portion 72 of the belt 21 are electrically connected to the power source portion 202 through the first electroconductive portion 76 and the second electroconductive portion 77, respectively, provided on the back-up member 22 which presses and urges the belt 21 toward the pressing roller 30. As a result, stable power supply from the power source portion 202 to the heat generating layer 21*b* can be realized. Through the conductive paths 75, the power supplying portion 71 and the power receiving portion 72 which are provided as an innermost layer of the belt 21 and contact the first electroconductive portion 76 and the second electroconductive portion 77, respectively, are electrically connected to the heat generating layer 21*b* provided on the innermost peripheral surface of the belt 21. As a result, from the power source portion 202 to the heat generating layer 21*b*, the power can be supplied stably.

Further, also in the fixing device 9 in this embodiment, with respect to the direction perpendicular to the recording material conveyance direction a in the nip N, the maximum sheet passing width WPmax of the recording material P is within (inside) a heat generation area width W21*b* of the heat generating layer 21*b*. Further, the heat generation area width W21*b* of the heat generating layer 21*b* is 307 mm and the maximum sheet passing width WPmax of the recording material P is 297 mm, so that the heat generating layer 21*b* is longer than the recording material P by 5 mm on each of the left and right sides thereof. As a result, similarly as in the case of the fixing device 9 in Embodiment 1, prevention of the change in temperature and prevention of the excessive temperature rise at recording material end positions are compatibly realized.

Embodiment 3

Figure 7:
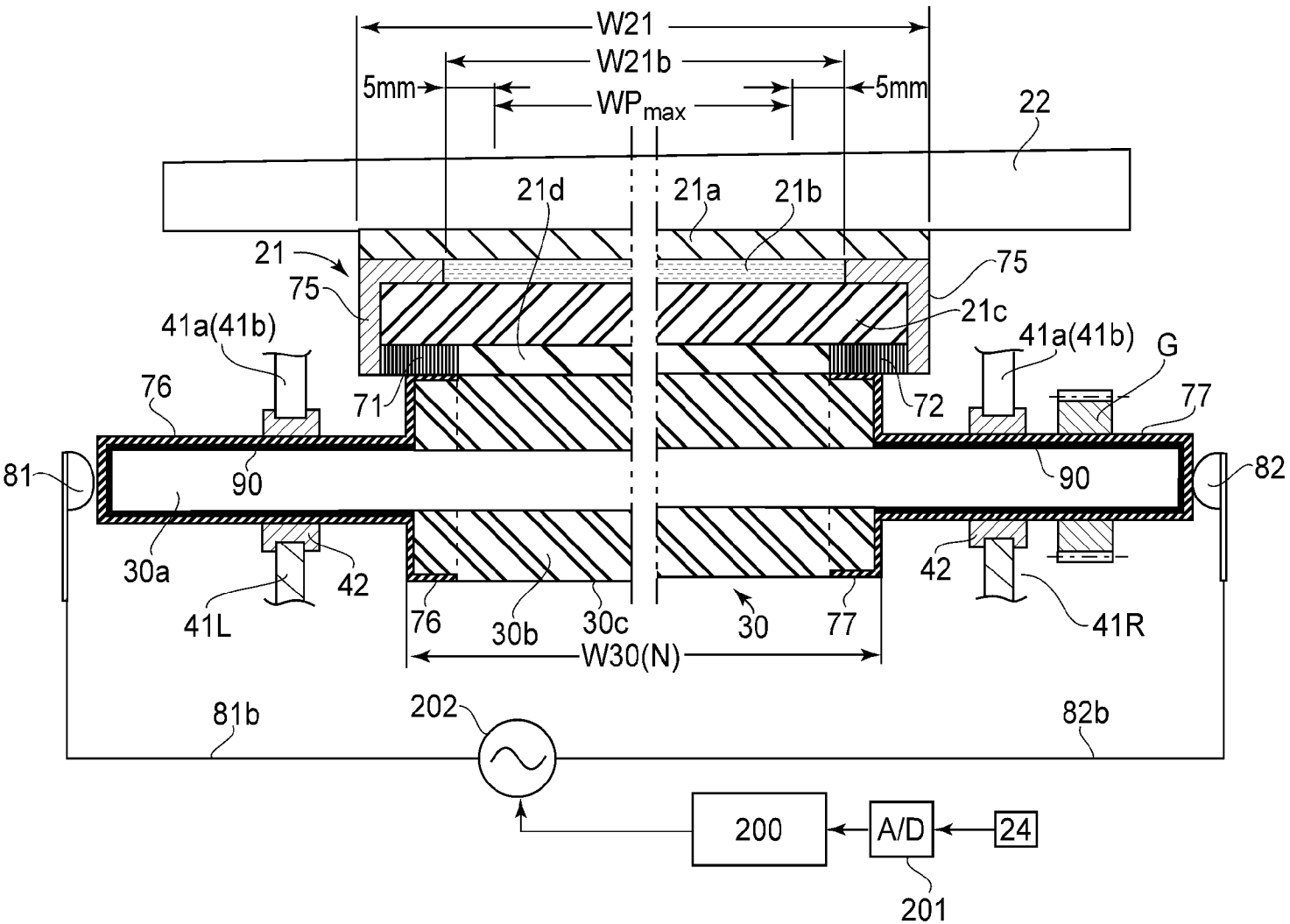
FIG. 7 is a schematic view showing an energization constitution with respect to an electroconductive layer in a fixing device in Embodiment 3.

FIG. 7 is a schematic view for illustrating a constitution in this embodiment. In this embodiment, the energization to the heat generating layer 21*b* is performed through the pressing roller 30. In this embodiment, constituent members or portions common to Embodiment 1 are represented by the same reference numerals or symbols and will be omitted from redundant description. FIG. 7 is the schematic view in which mutual ratios among respective constituent elements or portions with respect to the length, the width and the thickness are not always coincide with those shown in FIG. 2.

In the fixing device 9 in this embodiment, the belt 21 at least includes the heat generating layer 21*b* for generating heat by energization and includes the power supplying portion 71 and the power receiving portion 72 which are provided at the outermost surface of the belt 21 and are electrically connected to the heat generating layer 21*b* to possess the electroconductive property. Further, the pressing roller 30 includes the first electroconductive portion 76 and the second electroconductive portion 76 at portions corresponding to the power supplying portion 71 and the power receiving portion 72 of the belt 21, respectively. Further, the first electroconductive portion 76 and the second electroconductive portion 77 are electrically connected to the power source portion 202 for supplying the power to the heat generating layer 21*b*.

More specifically, the belt 21 in this embodiment basically has, similarly as in the case of the belt 21 in Embodiment 1, the four-layer composite structure consisting of the base layer 21*a*, the heat generating layer 21*b*, the elastic layer 21*c* and the parting layer 21*d* in the order from its inner peripheral surface side to its outer peripheral surface side. That is, the belt 21 includes the heat generating layer 21*b* formed on the outer peripheral surface of the cylindrical base layer 21*a*, the elastic layer 21*c* formed on the outer peripheral surface of the heat generating layer 21*b*, and the parting layer 21*d* formed at the outermost peripheral surface.

On the left and right sides of the outer surface of the belt 21, the power supplying portion 71 and the power receiving portion 72 which have electroconductivity and a ring-like shape with respect to the circumferential direction are formed, respectively. Further, the power supplying portion 71 and the power receiving portion 72 are electrically connected to the left and right ends of the heat generating layer 21*b*, respectively, through the conductive paths 75. That is, the conductive paths 75 for electrically connecting the power supplying portion 71 and the power receiving portion 72 to the heat generating layer 21*b* are formed via the end portions of the belt 21. The conductive paths 75 may only be required to be electrically connecting the power supplying portion 71 and the power receiving portion 72 to the heat generating layer 21*b* and thus may be free from a ring-like electroconductive pattern.

The pressing roller 30 is provided with the first electroconductive portion 76 on the left electroconductive portion side and the second electroconductive portion 77 on the right end portion side in a ring-like shape with respect to the circumferential direction at the outer surface thereof. The first electroconductive portion 76 and the second electroconductive portion 77 are provided in areas in which the portions 76 and 77 oppose the power supplying portion 71 and the power receiving portion 72, respectively, provided on the belt 21. The first electroconductive portion 76 is formed by being extended to cover the left-side end surface the pressing roller 30 and the left-side end portion of the core metal 30*a*. The second electroconductive portion 77 is formed by being extended to cover the right-side end surface of the pressing roller 30 and the right-side end portion of the pressing roller 30. That is, the first and second electroconductive portions 76 and 77 are formed so as to cover from the area in which the portions 76 and 77 oppose the power supplying portion 71 and the power receiving portion 72 of the belt 21 to the exposed portions of the core metal 30*a* of the pressing roller 30. In this case, the pressing roller 30 includes the core metal 30*a* of stainless steel which is the electroconductive material and therefore an insulating layer 90 is formed between the core metal 30*a* and the first electroconductive portion 76 and between the core metal 30*a* and the second electroconductive portion 77 to prevent electrical short therebetween. In the neighborhood of the center of the shaft of the core metal 30*a* at left and right end surfaces, the power supplying members 81 and 82 are elastically contacted to the first and second electroconductive portions 76 and 77, respectively. The power supplying members 81 and 82 are a leaf spring-like member of stainless steel. That is, an energization path for the heat generating layer 21*b* is constituted by the power source portion 202, a lead 81*b*, the power supplying member 81, the first electroconductive portion 76, the power supplying portion 71, the conductive path 75, the heat generating layer 21*b*, the conductive path 75, the power receiving portion 72, the second electroconductive portion 77, the power supplying member 82, a lead 82*b*, and the power source portion 202.

As described above, in this embodiment, the core metal 30*a* of the pressing roller 30 is formed of the electroconductive material and the exposed shaft portion of the core metal 30*a* is coated with the insulating material 90 and is further coated with the electroconductive material which is electrically connected to the first and second electroconductive portions 76 and 77. Further, the electrical connection between the first electroconductive portion 76 and the power source portion 202 and between the second electroconductive portion 77 and the power source portion 202 is performed at the center of the shaft of the pressing roller 30. In the case where the core metal 30*a* of the pressing roller 30 is formed of the insulating material, the exposed shaft portion is coated with the electroconductive material which is electrically connected to the first and second electroconductive portions 76 and 77. Further, with respect to the direction perpendicular to the recording material conveyance direction a in the nip N, the power supplying portion 71 and the power receiving portion 72 are located outside the maximum sheet passing width WPmax of the recording material P. A difference in length at a boundary between the power source (belt surface layer) 21*d* and the power supplying portion 71 of the belt 21 and at a boundary between the parting layer 21*d* and the power receiving portion 72 of the belt 21 may desirable be 100 μm or less. Further, a difference in height at a boundary between the parting layer (rotatable pressing member surface layer) 30*c* and the first electroconductive portion 76 of the pressing roller 30 and at a boundary between the parting layer 30*c* and the second electroconductive portion 77 of the pressing roller 30 may desirably be 100 μm or less.

In the fixing device 9 in this embodiment, during the rotation of the pressing roller 30, there is almost no influence of a difference in peripheral speed, so that the electrical connection between the power supplying member 81 and the first electroconductive portion 76 and between the power supplying member 82 and the second electroconductive portion 77 is satisfactorily maintained. Further, the back-up member 22 presses and urges the belt 21 including the power supplying portion 71 and the power receiving portion 72 and there is almost no influence of the difference in peripheral speed, so that the electrical connection between the first electroconductive portion 76 and the power supplying portion 71 and between the second electroconductive portion 77 and the power receiving portion 72 is also satisfactorily maintained. That is, by the constitution in this embodiment, the electrical connection between the power source portion 202 and the heat generating layer 21*b* can be stably maintained also during the drive of the fixing device 9.

Further, also in the fixing device 9 in this embodiment, with respect to the direction perpendicular to the recording material conveyance direction a in the nip N, the maximum sheet passing width WPmax of the recording material P is within (inside) a heat generation area width W21*b* of the heat generating layer 21*b*. Further, the heat generation area width W21*b* of the heat generating layer 21*b* is 307 mm and the maximum sheet passing width WPmax of the recording material P is 297 mm, so that the heat generating layer 21*b* is longer than the recording material P by 5 mm on each of the left and right sides thereof. As a result, similarly as in the case of the fixing devices 9 in Embodiments 1 and 2, prevention of the change in temperature and prevention of the excessive temperature rise at recording material end positions are compatibly realized.

As described above, according to this embodiment, in the fixing device using the belt 21 including the heat generating layer 21*b* for generating heat by energization, stable electric power supply to the heat generating layer 21*b* can be realized.

Here, the fixing device constitutions in Embodiments 1 to 3 described above do not limit the scope of the present invention and thus the constituent elements and materials of the image forming apparatus and the fixing device, particularly the belt 21 can be variously modified.

As described hereinabove, according to the present invention, with respect to the image heating apparatus using the belt including the heat generating layer for generating heat by energization, it is possible to realize stable electric power supply to the heat generating layer.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 274338/2009 filed Dec. 2, 2009, which is hereby incorporated by reference.

What is claimed is:

1. An image heating apparatus comprising:

an endless belt including an insulative base layer, a heat generating layer provided on said base layer and configured to generate heat for heating an image on a sheet at a nip portion, and an electroconductive power receiving portion configured to receive electric power and for supplying the received electric power to said heat generating layer;

a driving roller configured to drive said endless belt and to form the nip portion cooperatively with said endless belt;

a pressing pad provided inside said endless belt and configured to press said endless belt toward said driving roller; and an electroconductive power supplying portion, provided on a surface of said pressing pad facing said endless belt and configured to supply the electric power to said electroconductive power receiving portion.

2. An apparatus according to claim 1, wherein said electroconductive power receiving portion is disposed at a longitudinal one end portion of said endless belt, said electroconductive power supplying portion is disposed at a longitudinal one end portion of said pressing pad.

3. An apparatus according to claim 1, wherein said electroconductive power receiving portion is disposed at each of longitudinal end portions of said endless belt, and said electroconductive power supplying portion is disposed at each of longitudinal end portions of said pressing pad.

4. An apparatus according to claim 1, wherein said endless belt includes an elastic layer on said heat generating layer and a parting layer on said elastic layer, and wherein a part of said electroconductive power receiving portion is provided on said parting layer and is electrically connected said heat generating layer through a longitudinal end portion of said endless belt.

5. An apparatus according to claim 1, wherein said heat generating layer is formed of a material containing a resin material and an electroconductive material mixed in said resin material.

6. An apparatus according to claim 1, wherein said electroconductive power receiving portion is located outside a region in which the sheet having a maximum width is passed through the nip portion with respect to a direction perpendicular to a sheet conveyance direction.

7. An image heating apparatus comprising:

an endless belt including an insulative base layer, a heat generating layer provided on said base layer and configured to generate heat for heating an image on a sheet at a nip portion, and an electroconductive power receiving portion configured to receive electric power and for supplying the received electric power to said heat generating layer;

a driving roller configured to drive said endless belt and to form the nip portion cooperatively with said endless belt;

a pressing pad provided inside said endless belt and configured to press said endless belt toward said driving roller; and an electroconductive power supplying portion provided on a surface of said driving roller facing said endless belt and configured to supply the electric power to said electroconductive power receiving portion.

8. An apparatus according to claim 7, wherein said electroconductive power receiving portion is disposed at a longitudinal one end portion of said endless belt, and said electroconductive power supplying portion is disposed at a longitudinal one end portion of said driving roller.

9. An apparatus according to claim 7, wherein said electroconductive power receiving portion is disposed at each of longitudinal end portions of said endless belt, and said electroconductive power supplying portion is disposed at each of longitudinal end portions of said driving roller.

10. An apparatus according to claim 7, wherein said driving roller includes a metal core formed of an electroconductive material, an insulating material coated on an exposed shaft portion of said metal core, and an electroconductive material which is coated on the insulating material and is electrically connected to said electroconductive power supplying portion.

11. An apparatus according to claim 7, wherein said electroconductive power receiving portion is located outside a region in which the sheet having a maximum width is passed through the nip portion with respect to a direction perpendicular to a sheet conveyance direction.

* * * * *